US009932952B2

(12) United States Patent
Tsusaka

(10) Patent No.: US 9,932,952 B2
(45) Date of Patent: Apr. 3, 2018

(54) ELECTRICITY SUPPLY DEVICE AND VEHICLE

(71) Applicant: HONDA MOTOR CO., LTD., Tokyo (JP)

(72) Inventor: Hitoshi Tsusaka, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 580 days.

(21) Appl. No.: 14/662,861

(22) Filed: Mar. 19, 2015

(65) Prior Publication Data

US 2015/0275838 A1 Oct. 1, 2015

(30) Foreign Application Priority Data

Mar. 31, 2014 (JP) ..... 2014-073615

(51) Int. Cl.
*F02N 11/08* (2006.01)
*F02P 5/04* (2006.01)
*F02N 11/06* (2006.01)

(52) U.S. Cl.
CPC ..... *F02N 11/087* (2013.01); *F02N 11/0803* (2013.01); *F02N 11/06* (2013.01); *F02N 2200/103* (2013.01)

(58) Field of Classification Search
CPC .... F02N 11/087; F02N 11/0803; F02N 11/06; F02N 2200/103
USPC ..... 290/38 R, 40 R
See application file for complete search history.

(56) References Cited

U.S. PATENT DOCUMENTS 8,171,908 B2 * 5/2012 Senda ..... F02N 11/0844 123/179.4
2005/0140332 A1 * 6/2005 Shiokawa ..... B62J 6/003 320/104
2007/0245996 A1 * 10/2007 Sasaki ..... F02N 3/04 123/179.2
2008/0276892 A1 * 11/2008 Doljack ..... F02N 11/0866 123/179.28
2010/0244459 A1 * 9/2010 Gibson ..... F02N 11/0866 290/38 R
2010/0299053 A1 * 11/2010 Okumoto ..... F02N 11/0855 701/113
2011/0248803 A1 * 10/2011 Niimi ..... F02N 11/087 335/202

(Continued)

FOREIGN PATENT DOCUMENTS

JP 2005-193703 7/2005

*Primary Examiner* — Viet Nguyen
(74) *Attorney, Agent, or Firm* — Rankin, Hill & Clark LLP

(57) ABSTRACT

An electricity supply device that reduces a delay in starting an engine. A vehicle includes a starter motor for starting an engine, a start magnet making and breaking connection between the starter motor and a battery, a fuel pump, and a control unit controlling fuel injection and ignition timing of the engine. An electricity supply device of the vehicle includes: a main relay making and breaking connection between a load of the vehicle, the load not including the starter motor, the start magnet, and the battery; a clutch switch connected to the battery, and set in a conducting state when a clutch lever is gripped; a start switch connected between the clutch switch and a coil of the start magnet; and a diode allowing a current to flow from a point of connection between the clutch switch and the start switch to a coil of the main relay.

20 Claims, 7 Drawing Sheets

(56) References Cited

U.S. PATENT DOCUMENTS

2012/0060786 A1* 3/2012 Okada ..... F02N 11/087
123/179.5
2012/0139263 A1* 6/2012 Weinum ..... F02N 11/0851
290/38 R

* cited by examiner

ELECTRICITY SUPPLY DEVICE AND VEHICLE

BACKGROUND OF THE INVENTION

Field of the Invention

The present invention relates to an electricity supply device that supplies a vehicle with power generated by a generator and/or the power of a battery, and the vehicle.

Description of Related Art

In a vehicle for competition, a main switch that turns on and off the supply of power from a battery to various parts of the vehicle excluding a starter motor is omitted to reduce switch parts. In order to prevent a start of an engine when only a start switch is turned on, Japanese Patent Laid-Open No. 2005-193703 discloses an invention that supplies the power of a battery to a starter motor via a starter magnet switch to start the engine when both of a switch turned on when a clutch lever is gripped (which switch will hereinafter be referred to as a clutch switch) and the start switch are turned on.

In FIG. 6 of Japanese Patent Laid-Open No. 2005-193703, when a clutch switch 61 is turned on and a start switch 41 connected in series with the clutch switch 61 is turned on, the direct-current power of a battery 64 starts to be supplied to an ignition control unit 67 and a starter magnet 62. Supplied with the battery power, the ignition control unit 67 closes the contact of a main relay 70 to supply the battery power to a general load 71. In addition, a contact of the starter magnet 62 supplied with the battery power is closed. Thus, a current flows from the battery 64 to a starter motor 63 to rotate the starter motor 63, so that the engine is started.

ECU-equipped vehicles that perform engine control by an electronic control unit (ECU) have recently spread. In the case of an ECU-equipped vehicle having a main switch, a fuel pump operates in such a manner as to be operatively associated with the turning on of the main switch to set a state in which a fuel can be supplied to an engine.

When the invention of Japanese Patent Laid-Open No. 2005-193703 is applied to an ECU-equipped vehicle for competition which vehicle does not have a main switch, both of the clutch switch 61 and the start switch 41 are turned on, and thereafter the contact of the main relay 70 is closed by control of the ECU to supply the battery power to the load including a fuel pump. As a result, a delay occurs in starting fuel supply after the turning on of the start switch 41, and thus a delay occurs in starting the engine.

SUMMARY OF THE INVENTION

It is an object of the present invention to provide an electricity supply device suitable for a vehicle for competition which electricity supply device prevents or reduces a delay in starting an engine.

In accordance with the present invention, there is provided an electricity supply device for a vehicle, the vehicle including a starter motor for starting an engine, a start magnet making and breaking connection between the starter motor and a battery, a fuel pump, and a control unit controlling fuel injection and ignition timing of the engine. The electricity supply device includes: a main relay making and breaking connection between a load of the vehicle, the load not including the starter motor and the start magnet, and the battery; a clutch switch connected to the battery, and set in a conducting state in a state of a clutch lever being gripped; a start switch connected between the clutch switch and a coil of the start magnet; and a diode allowing a current to flow from a point of connection between the clutch switch and the start switch to a coil of the main relay. Accordingly, it is possible to provide an electricity supply device that can prevent or reduce a delay in starting the engine.

In further accordance with the present invention, when the clutch switch is set in the conducting state, a current flows from the battery through the diode to the coil of the main relay to set the main relay in a conducting state, whereby the vehicle is set in a state in which the engine can be started. Accordingly, the state in which the engine can be started is set before the start switch is set in a conducting state.

In further accordance with the present invention, an electricity supply device for a vehicle, the vehicle including a starter motor for starting an engine, a start magnet making and breaking connection between the starter motor and a battery, a fuel pump, and a control unit controlling fuel injection and ignition timing of the engine, the electricity supply device including: a main relay making and breaking connection between a power supply line supplying direct-current power to a load of the vehicle, the load not including the starter motor and the start magnet, and the battery; a clutch switch connected to the battery, and set in a conducting state in a state of a clutch lever being gripped; a start switch connected between the clutch switch and a coil of the start magnet; and a diode allowing a current to flow from a point of connection between the clutch switch and the start switch to the power supply line. Accordingly, it is possible to provide an electricity supply device that can prevent or reduce a delay in starting the engine.

In further accordance with the present invention, when the clutch switch is set in the conducting state, the direct-current power of the battery is supplied to the power supply line via the diode, whereby the vehicle is set in a state in which the engine can be started.

In further accordance with the present invention, after the state in which the engine can be started is set, the control unit controls an opened state and a closed state of the main relay. As such, the main relay can be provided with a function similar to that of the main switch.

In further accordance with the present invention, when an engine starting state is set in which the clutch switch is in a conducting state and the start switch is in a conducting state, a current flows from the battery to the coil of the start magnet, whereby the starter motor and the battery are connected to each other. As such, the engine can be started on condition that both of the clutch switch and the main switch is in a conducting state.

In further accordance with the present invention, when a first predetermined time has passed without the engine starting state being set after the state in which the engine can be started is set, the control unit sets the main relay in a nonconducting state. Furthermore, when a second predetermined time has passed without the engine starting state being set after a stop of the engine is detected, the control unit sets the main relay in a nonconducting state. Therefore, consumption of charge power of the battery can be reduced.

DETAILED DESCRIPTION OF THE INVENTION

An electricity supply device according to an embodiment of the present invention will hereinafter be described in detail with reference to the drawings. The following description will be made of an embodiment in which an electricity supply device according to the present invention is applied to a motorcycle for competition. However, vehicles to which the electricity supply device according to the present invention is applicable are not limited to motorcycles for competition, but the electricity supply device according to the present invention is applicable also to all-terrain vehicles (ATVs) such as three-wheeled vehicles and four-wheeled vehicles for competition and the like.

Figure 1:
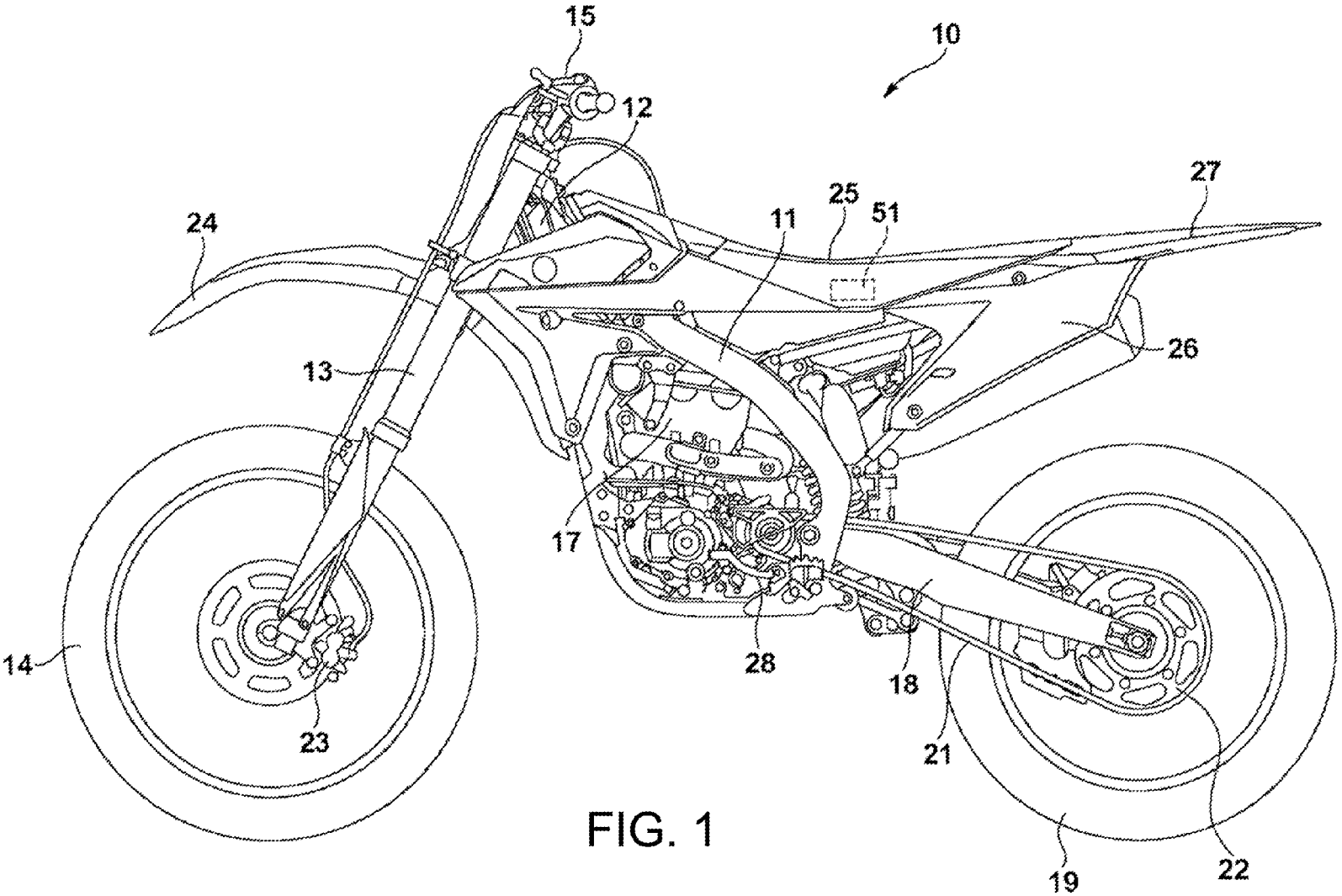
FIG. 1 is a left side view of a motorcycle.
Figure 2:
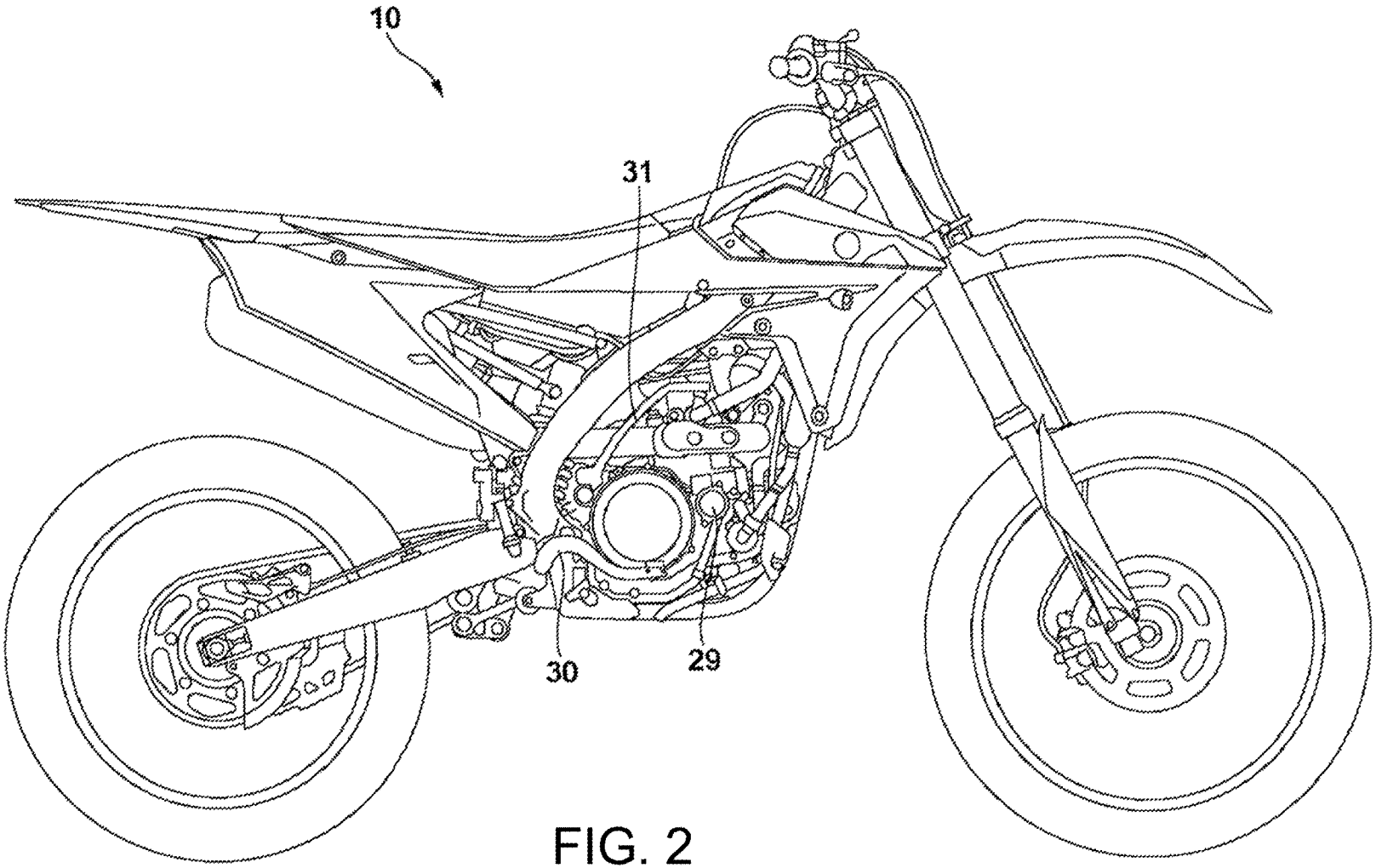
FIG. 2 is a right side view of the motorcycle.

FIG. 1 is a left side view of a motorcycle 10 as a kind of saddle riding type vehicle. FIG. 2 is a right side view of the motorcycle 10. Incidentally, the traveling direction of the motorcycle 10 is a forward direction, a left side as viewed in the traveling direction being a left side surface, and a right side as viewed in the traveling direction being a right side surface.

The motorcycle (hereinafter a vehicle) 10 for example has a head pipe 12 at the front end of a vehicle body frame 11. A front fork 13 is provided to the head pipe 12. A front wheel 14 is rotatably attached to the lower portion of the front fork 13. Steering handlebars 15 are attached to the upper end of the front fork 13.

An engine 17 is mounted in the center of the vehicle body frame 11. A swing arm 18 extends from the rear portion of the vehicle body frame 11. A rear wheel 19 is rotatably attached to the rear portion of the swing arm 18. The rear wheel 19 is driven by the engine 17 using a chain 21 and a sprocket 22.

The vehicle 10 further includes a brake caliper 23, a front fender 24, a seat 25, a rear side cover 26, and a rear fender 27. In addition, the vehicle 10 has a shift pedal 28 on the left side surface, and has a starter motor 29, a rear brake pedal 30, and a kick start pedal 31 on the right side surface.

The vehicle 10 of the type shown in FIG. 1 and FIG. 2 is a vehicle for competition which vehicle travels on an unpaved closed course or the like, and thus does not have equipment for traveling on ordinary public roads.

Figure 3:
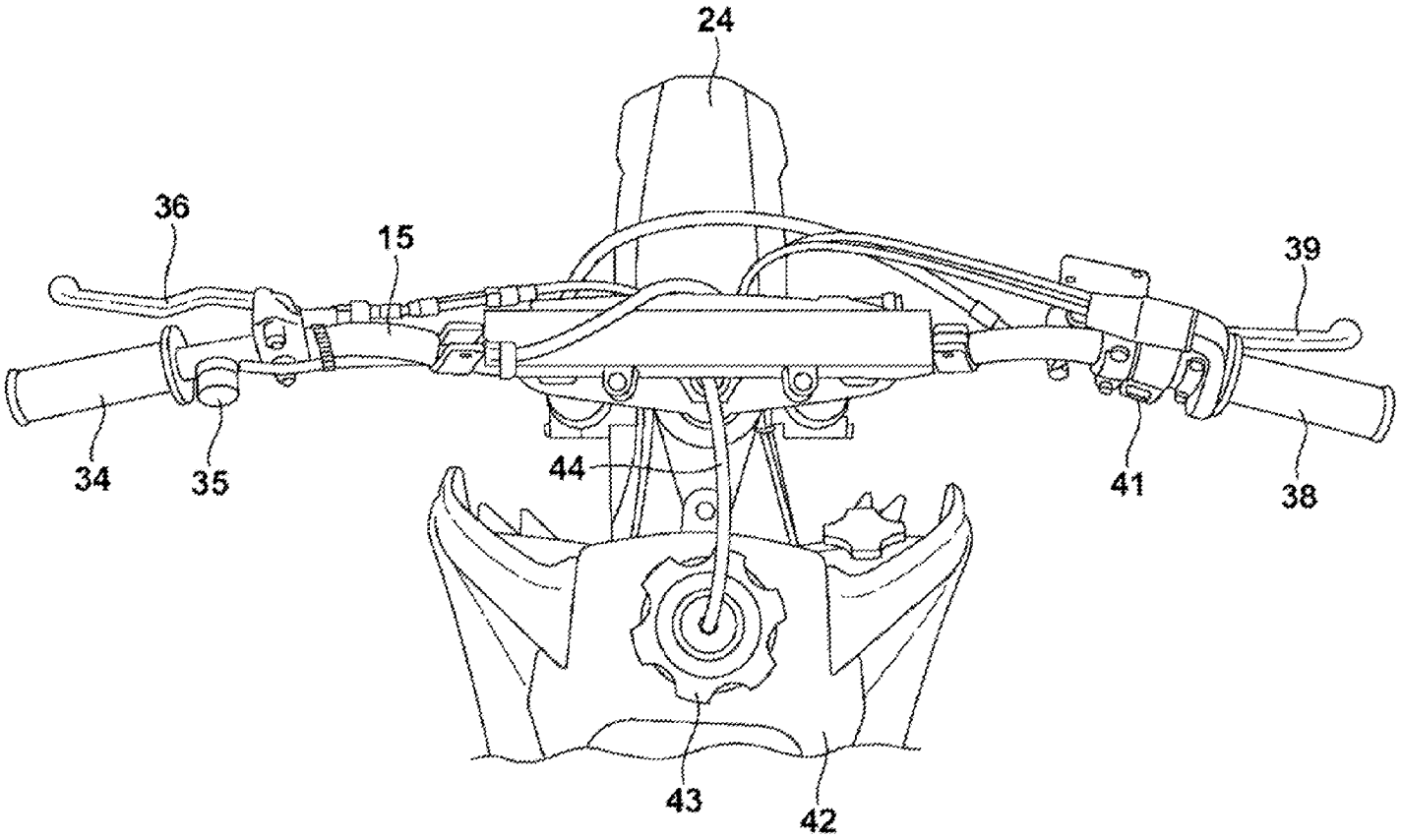
FIG. 3 is a plan view of a front portion of the motorcycle.

FIG. 3 is a plan view of the front portion of the vehicle 10. The steering handlebars 15 in the shape of a bar handle have an engine stop switch 35, a clutch lever 36 as an operating lever, and the like arranged in the vicinity of a left grip 34. A front brake lever 39, a start switch 41, and the like are arranged in the vicinity of a throttle grip 38 on the right side. A fuel tank 42, a refueling cap 43, and a vent pipe 44 are also provided.

In addition, as shown in FIG. 1, a control unit 51 is disposed under the seat 25.

Figure 4:
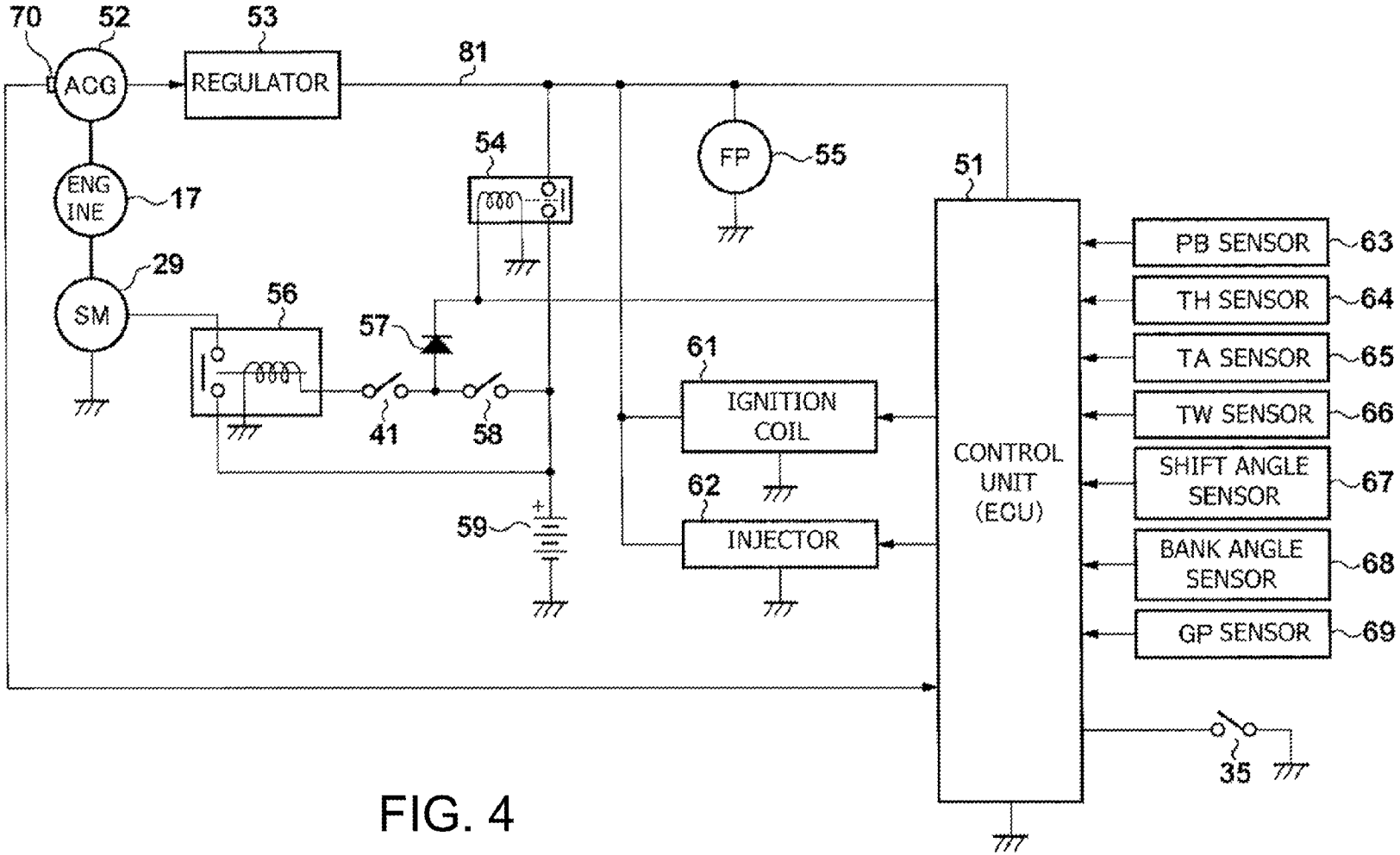
FIG. 4 is a diagram of assistance in explaining an example of configuration of an electricity supply circuit and a control unit and peripheries thereof in the embodiment.

FIG. 4 is a diagram of assistance in explaining an example of configuration of an electricity supply circuit in the embodiment and the control unit 51 and peripheries thereof.

The control unit 51 is an electronic control unit (ECU) that is formed by a microcontroller (CPU) and which controls various parts of the vehicle 10. The control unit 51 obtains information from various parts of the vehicle 10 including operations of a driver, and controls the operation of the engine 17 and the like on the basis of the obtained information.

The control unit 51 has input ports connected with various kinds of sensors including an intake air pressure (negative pressure) (PB) sensor 63, a throttle valve opening degree (TH) sensor 64, an intake air temperature (TA) sensor 65, a water temperature (TW) sensor 66, a shift angle sensor 67 for quick shifting, a bank angle sensor 68 for stopping the engine 17 when the vehicle is overturned, and a gear position (GP) sensor 69 as well as an engine stop switch 35 and the like.

The control unit 51 has output ports connected with an ignition coil 61 for supplying a high voltage to an ignition plug of the engine 17, an injector 62 for injecting a fuel, and the like. The control unit 51 thus controls ignition timing and fuel injection. In addition, a coil of a main relay 54 is connected to an output port of the control unit 51, so that the control unit 51 can control the opened/closed state of a contact of the main relay 54.

A generator (ACG) 52 is driven by the engine 17 to generate power. A regulator 53 converts the power output from the ACG 52 into direct-current power of a voltage appropriate for being supplied to loads of the vehicle 10 and charging a battery 59. A pulse generator 70 disposed in the vicinity of the ACG 52 generates a pulse signal according to the rotation of a rotor of the ACG 52. This pulse signal is input to the control unit 51, and is used to detect engine speed or the like.

The direct-current power output by the regulator 53 is supplied to various kinds of loads including the control unit 51, a fuel pump (FP) 55, the ignition coil 61, and the injector 62 via a power supply line 81. When the engine 17 is rotating, and the direct-current power is supplied from the regulator 53, the control unit 51 closes the contact of the main relay 54, so that the battery 59 is charged by the direct-current power output by the regulator 53.

The main relay 54 has a function corresponding to that of a main switch of a vehicle. The contact of the main relay 54 is closed on the basis of an operation of the clutch lever 36 to be described later. After the contact is once closed, the control unit 51 controls the closing and opening of the contact.

A clutch switch 58 is a switch operatively associated with the operation of the clutch lever 36. The clutch switch 58 is on (in a conducting state in which the contact is closed) in a state of the clutch lever being gripped. One terminal of the clutch switch 58 is connected to a point of connection between the contact of the main relay 54 and the positive electrode of the battery 59. Another terminal of the clutch switch 58 is connected to one terminal of the start switch 41 and an anode of a start diode 57. A cathode of the start diode 57 is connected to the coil of the main relay 54.

On the other hand, another terminal of the start switch 41 is connected to a coil of a starter magnet 56. A contact of the starter magnet 56 is disposed between the battery 59 and the starter motor (SM) 29. That is, when a current flows from the battery 59 to the coil of the starter magnet 56 to close the contact of the starter magnet 56, a current flows from the battery 59 to the starter motor 29 to perform an engine starting operation in which the starter motor 29 rotates.

An occupant of the vehicle 10 first grips the clutch lever 36. This operation turns on the clutch switch 58 operatively associated with the operation of the clutch lever 36, so that a current flows from the battery 59 through the clutch switch 58 and the start diode 57 to the coil of the main relay 54 to close the contact of the main relay 54. That is, the start diode 57 allows the current to flow from the point of connection between the clutch switch 58 and the start switch 41 to the coil of the main relay 54, so that the contact of the main relay 54 is closed.

When the contact of the main relay 54 is closed, power starts to be supplied from the battery 59 to various kinds of loads of the vehicle 10 which loads include the control unit 51 and the fuel pump (FP) 55, thus resulting in a starting preparatory state in which the engine 17 can be started. In addition, the supply of a current from the control unit 51 to the coil of the main relay 54 becomes possible, so that the closed state of the contact of the main relay 54 is maintained.

The occupant of the vehicle 10 next pushes a knob of the start switch 41. As a result of this operation, both of the clutch switch 58 and the start switch 41 are turned on (engine starting state), and the above-described engine starting operation is performed to start the engine 17.

Figure 5:
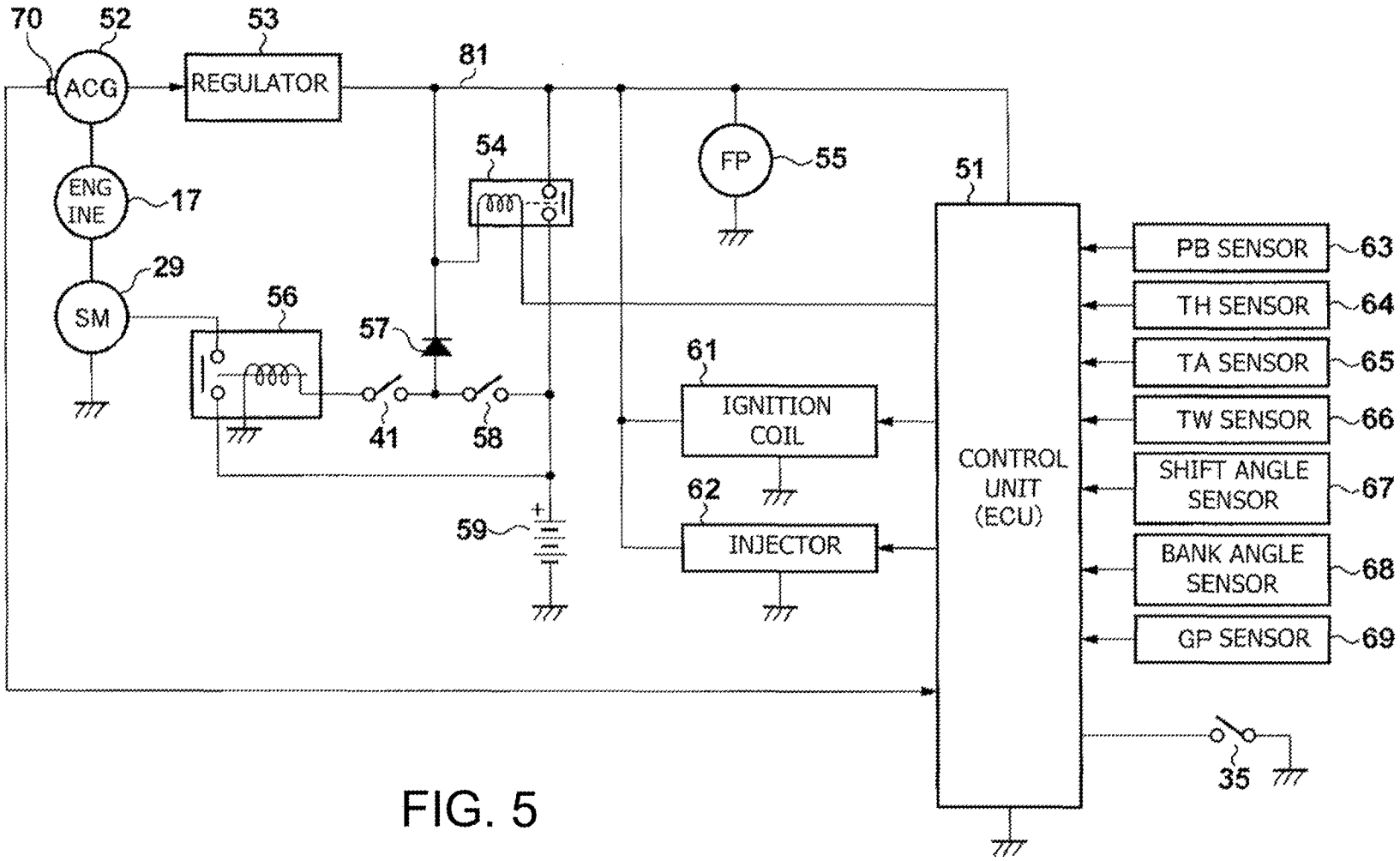
FIG. 5 is a diagram of assistance in explaining another example of configuration of the electricity supply circuit and the control unit and the peripheries thereof.

FIG. 5 is a diagram of assistance in explaining another example of configuration of the electricity supply circuit and the control unit 51 and peripheries thereof. The connection of the start diode 57 is not limited to FIG. 4. As shown in FIG. 5, the destination to which the cathode of the start diode 57 is connected may be changed from the coil of the main relay 54 to the power supply line 81 that supplies direct-current power from the regulator 53 to various parts of the vehicle 10.

In the case of the electricity supply circuit shown in FIG. 5, when the clutch switch 58 is turned on by an operation of the clutch lever 36, the direct-current power of the battery 59 is supplied to the power supply line 81 via the clutch switch 58 and the start diode 57, thus resulting in a starting preparatory state in which the engine 17 can be started. That is, the start diode 57 allows a current to flow from the point of connection between the clutch switch 58 and the start switch 41 to the power supply line 81, so that the battery power is supplied to the power supply line 81, which supplies the direct-current power to loads of the vehicle 10 excluding the starter motor 29 and the start magnet 56.

In addition, the coil of the main relay 54 is connected to the power supply line 81. When, for example, an open collector switch of an output port of the control unit 51 is energized, a current flows through the coil to set the contact of the main relay 54 in a closed state. Incidentally, the main relay 54 and the control unit 51 may be connected to each other by the method of FIG. 4.

In addition, in a case where the occupant of the vehicle 10 performs a kick start of the engine 17, when the ACG 52 is rotated by the operation of the start pedal 31, and a direct-current voltage equal to or higher than 6 V, for example, is supplied from the regulator 53, then the control unit 51, the fuel pump (FP) 55, the ignition coil 61, the injector 62, and the like become able to operate to start the engine 17.

Figure 6:
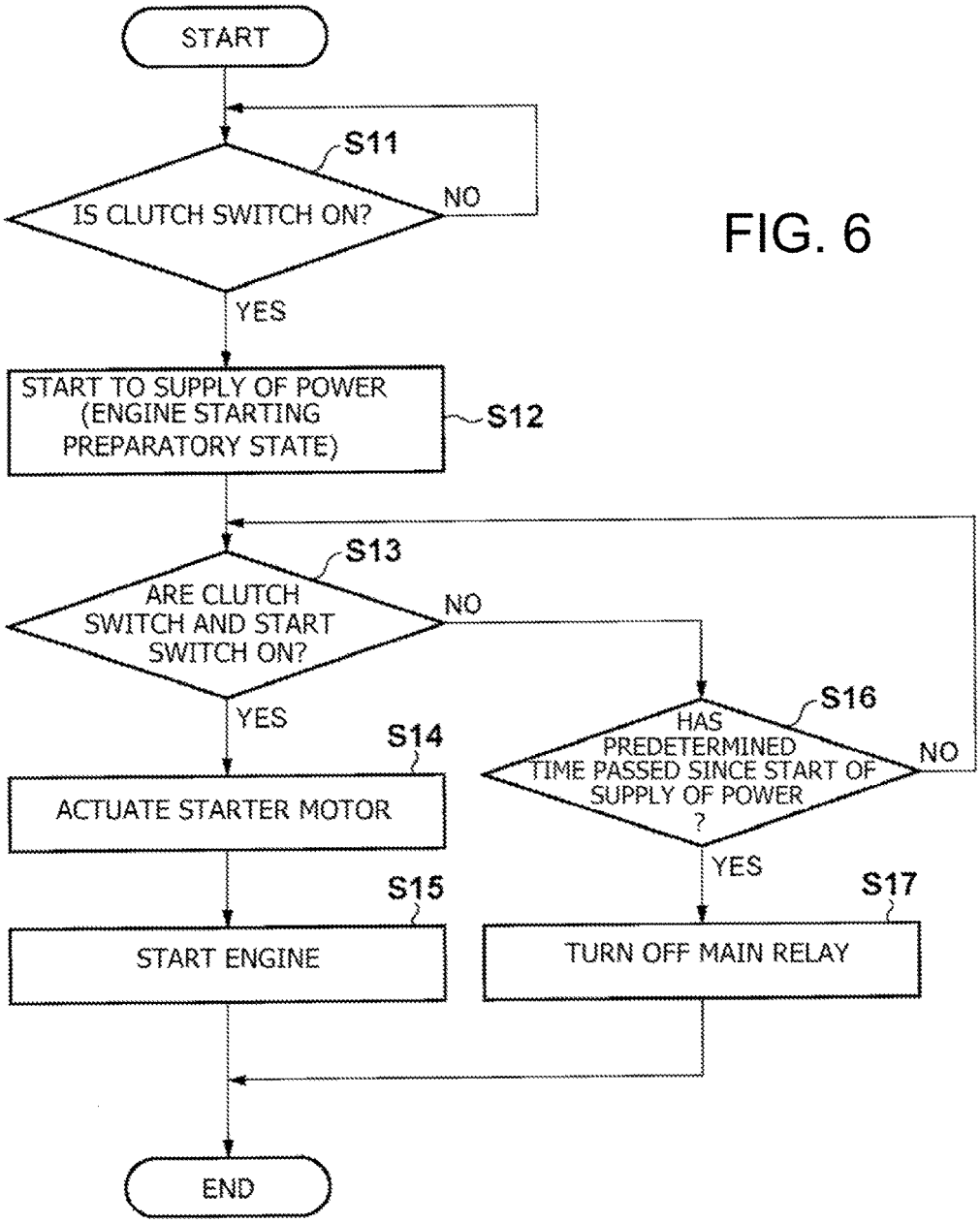
FIG. 6 is a flowchart of assistance in explaining a procedure for starting an engine.

FIG. 6 is a flowchart of assistance in explaining a procedure for starting the engine 17.

When the occupant of the vehicle 10 turns on the clutch switch 58 by operation of the clutch lever 36 (S11), the direct-current power of the battery 59 started to be supplied to various parts of the vehicle 10, thus resulting in a starting preparatory state in which the engine can be started (S12).

Next, when an engine starting state is set in which the start switch 41 is turned on by the occupant in the state of the clutch switch 58 being on (S13), the contact of the starter magnet 56 is closed to actuate the starter motor (SM) 29 (S14), so that the engine 17 is started (S15).

When the control unit 51 is supplied with the direct-current power and starts to operate, the control unit 51 starts to measure time. Then, when it is determined in step S16 that a first predetermined time (for example a period of 10 seconds) has passed with the clutch switch 58 and the start switch 41 not set in the engine starting state, the contact of the main relay 54 is opened to set the main relay 54 in a nonconducting state (main relay off) (S17).

The determination in step S16 and the turning off of the main relay in step S17 are a process for reducing consumption of the charge power of the battery 59 in a case where the occupant merely checks the operation of the clutch lever 36 before a start of the engine, and does not start the engine 17, for example. That is, the turning off of the main relay corresponds to the turning off of the main switch, and the charge power of the battery 59 is not supplied to the loads of the vehicle 10 in the off state of the main relay.

If the first predetermined time has passed with the occupant gripping the clutch lever 36, according to the configuration of FIG. 4, a current is flowing through the coil of the main relay 54 via the start diode 57, and therefore the main relay is not turned off irrespective of the control of the control unit 51. In this case, when the occupant releases the clutch lever 36, the main relay is turned off, and the procedure for starting the engine 17 returns to step S11. When the occupant turns on the start switch 41 while gripping the clutch lever 36, the engine 17 is started, and the control unit 51, which detects the start of the engine 17 on the basis of a pulse signal from the pulse generator 70, cancels the off state of the main relay.

In addition, if the first predetermined time has passed with the occupant gripping the clutch lever 36, according to the configuration of FIG. 5, the main relay is turned off. However, battery power is supplied to the power supply line 81 via the start diode 57. In this case, when the occupant releases the clutch lever 36, the supply of the battery power to the power supply line 81 is stopped, and the procedure for starting the engine 17 returns to step S11. When the occupant turns on the start switch 41 while gripping the clutch lever 36, the engine 17 is started, and the control unit 51, which detects the start of the engine 17 on the basis of a pulse signal from the pulse generator 70, cancels the off state of the main relay.

Figure 7:
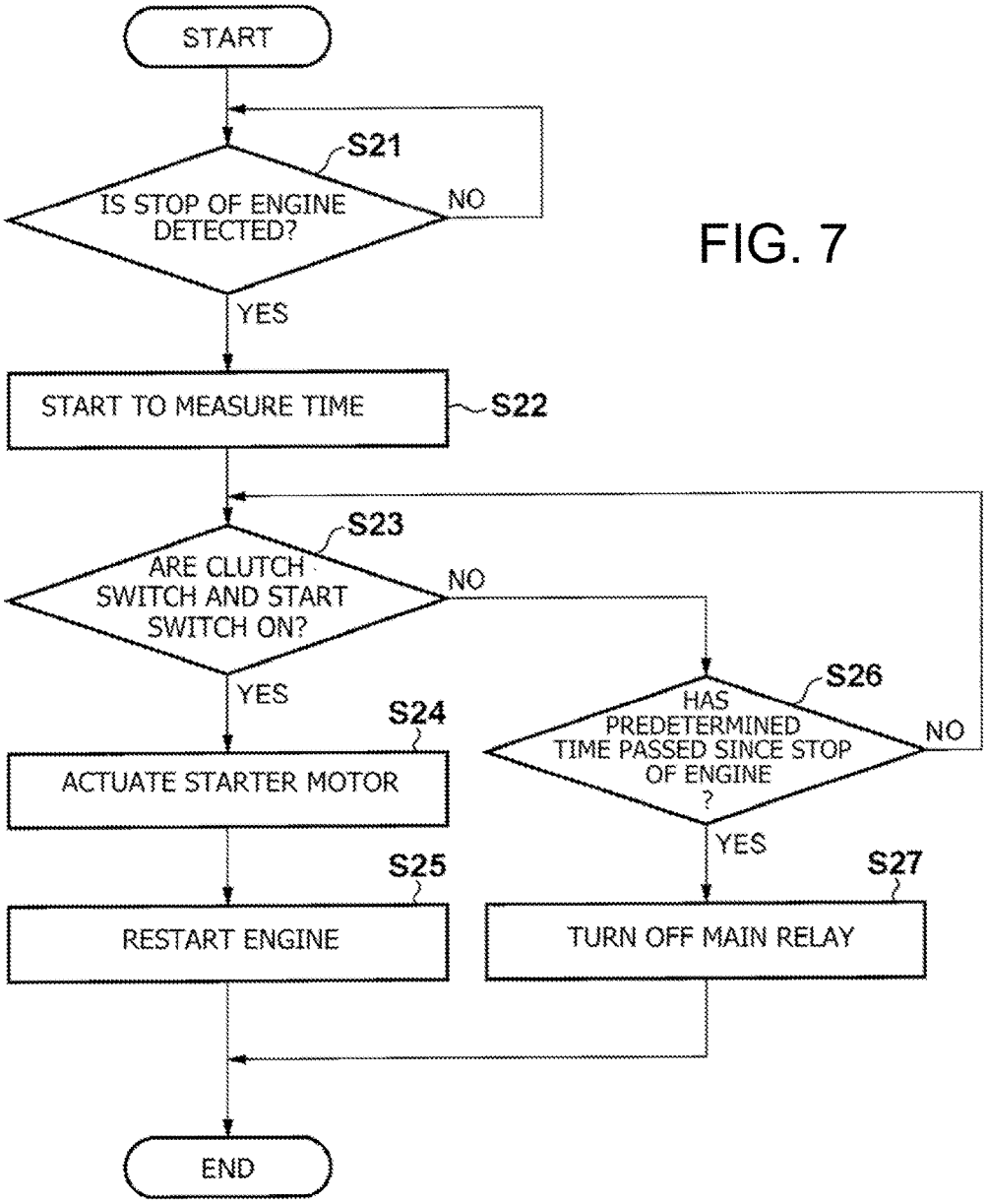
FIG. 7 is a flowchart of assistance in explaining the restarting of the engine and the turning off of a main relay.

FIG. 7 is a flowchart of assistance in explaining the restarting of the engine and the turning off of the main relay.

The control unit 51 stops the engine 17 when the engine stop switch 35 is turned on by the occupant of the vehicle 10 or the like or when the control unit 51 detects an overturn of the vehicle on the basis of the output signal of the bank angle sensor 68. When the engine 17 is stopped after a start of the engine 17, the control unit 51 maintains the closed state of the contact of the main relay 54 (main relay on). The supply of the direct-current power of the battery 59 to various parts of the vehicle 10 is therefore continued (engine starting preparatory state) (corresponding to the on state of the main switch). Hence, the control unit 51 is also in an operating state, and is thus able to detect a stop of the engine 17 on the basis of the pulse signal output by the pulse generator 70.

When the control unit 51 detects a stop of the engine (S21), the control unit 51 starts to measure time (S22). After the stop of the engine 17, when the clutch switch 58 and the start switch 41 are set in an engine starting state as at a time of a start of the engine (S23), the contact of the starter magnet 56 is closed to actuate the starter motor (SM) 29 (S24), so that the engine 17 is restarted (S25).

The control unit 51 determines whether or not a second predetermined time has passed with the clutch switch 58 and the start switch 41 not set in the engine starting state (S26). When the second predetermined time has passed, the control unit 51 opens the contact of the main relay 54 to set the main relay 54 in a nonconducting state (main relay off) (S27). Incidentally, the second predetermined time may be the same as the first predetermined time, or may be shorter than the first predetermined time.

The determination in step S26 and the turning off of the main relay in step S27 are a process corresponding to the turning off of the main switch for reducing consumption of the charge power of the battery 59 after the stop of the engine.

Thus, the start diode 57 disposed at the point of connection between the clutch switch 58 and the start switch 41 makes it possible to set a state in which the engine 17 can be started at a point in time of turning on the clutch switch 58, and therefore prevent or reduce a delay in starting the engine when the start switch 41 is thereafter turned on.

What is claimed is:

1. An electricity supply device for a vehicle, the vehicle including a starter motor for starting an engine, a start magnet making and breaking connection between the starter motor and a battery, a fuel pump, and a control unit controlling fuel injection and ignition timing of the engine, the electricity supply device comprising:

a main relay making and breaking connection between a load of the vehicle, the load not including the starter motor and the start magnet, and the battery;

a clutch switch connected to the battery, and set in a conducting state in a state of a clutch lever being gripped;

a start switch connected between the clutch switch and a coil of the start magnet; and a diode allowing a current to flow from a point of connection between the clutch switch and the start switch to a coil of the main relay.

2. The electricity supply device according to claim 1, wherein when the clutch switch is set in the conducting state, a current flows from the battery through the diode to the coil of the main relay to set the main relay in a conducting state, whereby the vehicle is set in a state in which the engine can be started.

3. The electricity supply device according to claim 2, wherein after the state in which the engine can be started is set, the control unit controls an opened state and a closed state of the main relay.

4. The electricity supply device according to claim 3, wherein when an engine starting state is set in which the clutch switch is in a conducting state and the start switch is in a conducting state, a current flows from the battery to the coil of the start magnet, whereby the starter motor and the battery are connected to each other.

5. The electricity supply device according to claim 2, wherein when an engine starting state is set in which the clutch switch is in a conducting state and the start switch is in a conducting state, a current flows from the battery to the coil of the start magnet, whereby the starter motor and the battery are connected to each other.

6. The electricity supply device according to claim 1, wherein when an engine starting state is set in which the clutch switch is in a conducting state and the start switch is in a conducting state, a current flows from the battery to the coil of the start magnet, whereby the starter motor and the battery are connected to each other.

7. The electricity supply device according to claim 6, wherein when a first predetermined time has passed without the engine starting state being set after the state in which the engine can be started is set, the control unit sets the main relay in a nonconducting state.

8. The electricity supply device according to claim 7, wherein when a second predetermined time has passed without the engine starting state being set after a stop of the engine is detected, the control unit sets the main relay in a nonconducting state.

9. The electricity supply device according to claim 6, wherein when a second predetermined time has passed without the engine starting state being set after a stop of the engine is detected, the control unit sets the main relay in a nonconducting state.

10. An electricity supply device for a vehicle, the vehicle including a starter motor for starting an engine, a start magnet making and breaking connection between the starter motor and a battery, a fuel pump, and a control unit controlling fuel injection and ignition timing of the engine, the electricity supply device comprising:

a main relay making and breaking connection between a power supply line supplying direct-current power to a load of the vehicle, the load not including the starter motor and the start magnet, and the battery;

a clutch switch connected to the battery, and set in a conducting state in a state of a clutch lever being gripped;

a start switch connected between the clutch switch and a coil of the start magnet; and a diode allowing a current to flow from a point of connection between the clutch switch and the start switch to the power supply line.

11. The electricity supply device according to claim 10, wherein when the clutch switch is set in the conducting state, the direct-current power of the battery is supplied to the power supply line via the diode, whereby the vehicle is set in a state in which the engine can be started.

12. The electricity supply device according to claim 11, wherein after the state in which the engine can be started is set, the control unit controls an opened state and a closed state of the main relay.

13. The electricity supply device according to claim 11, wherein when an engine starting state is set in which the clutch switch is in a conducting state and the start switch is in a conducting state, a current flows from the battery to the coil of the start magnet, whereby the starter motor and the battery are connected to each other.

14. The electricity supply device according to claim 10, wherein when an engine starting state is set in which the clutch switch is in a conducting state and the start switch is in a conducting state, a current flows from the battery to the coil of the start magnet, whereby the starter motor and the battery are connected to each other.

15. A vehicle, comprising:

a starter motor for starting an engine, a start magnet making and breaking connection between the starter motor and a battery, a fuel pump, a control unit controlling fuel injection and ignition timing of the engine, and, an electricity supply device, said electrical supply device comprising:

a main relay making and breaking connection between a load of the vehicle, the load not including the starter motor and the start magnet, and the battery;

a clutch switch connected to the battery, and set in a conducting state in a state of a clutch lever being gripped;

a start switch connected between the clutch switch and a coil of the start magnet; and a diode allowing a current to flow from a point of connection between the clutch switch and the start switch to a coil of the main relay.

16. A vehicle, comprising:

a starter motor for starting an engine, a start magnet making and breaking connection between the starter motor and a battery, a fuel pump, a control unit controlling fuel injection and ignition timing of the engine, and, an electricity supply device, said electricity supply device comprising:

a main relay making and breaking connection between a power supply line supplying direct-current power to a load of the vehicle, the load not including the starter motor and the start magnet, and the battery;

a clutch switch connected to the battery, and set in a conducting state in a state of a clutch lever being gripped;

a start switch connected between the clutch switch and a coil of the start magnet; and a diode allowing a current to flow from a point of connection between the clutch switch and the start switch to the power supply line.

17. The vehicle according to claim 16, wherein when the clutch switch is set in the conducting state, the direct-current power of the battery is supplied to the power supply line via the diode, whereby the vehicle is set in a state in which the engine can be started.

18. The vehicle according to claim 17, wherein after the state in which the engine can be started is set, the control unit controls an opened state and a closed state of the main relay.

19. The vehicle according to claim 18, wherein when an engine starting state is set in which the clutch switch is in a conducting state and the start switch is in a conducting state, a current flows from the battery to the coil of the start magnet, whereby the starter motor and the battery are connected to each other.

20. The vehicle according to claim 19, wherein when a first predetermined time has passed without the engine starting state being set after the state in which the engine can be started is set, the control unit sets the main relay in a nonconducting state.

* * * * *